US009440839B1

(12) United States Patent
Cleland et al.

(10) Patent No.: US 9,440,839 B1
(45) Date of Patent: Sep. 13, 2016

(54) PREFERENTIAL DISTRIBUTION OF COOLING CAPACITY

(71) Applicant: Cleland Sales Corporation, Los Alamitos, CA (US)

(72) Inventors: James M. Cleland, Los Alamitos, CA (US); Adam Cleland, Los Alamitos, CA (US)

(73) Assignee: Cleland Sales Corporation, Los Alamitos, CA (US)

( * ) Notice: Subject to any disclaimer, the term of this patent is extended or adjusted under 35 U.S.C. 154(b) by 0 days.

(21) Appl. No.: 14/988,609

(22) Filed: Jan. 5, 2016

(51) Int. Cl.
*B67D 3/00* (2006.01)
*F25D 21/08* (2006.01)
*F25D 31/00* (2006.01)

(52) U.S. Cl.
CPC ..... *B67D 3/0009* (2013.01); *B67D 3/0022* (2013.01); *B67D 3/0058* (2013.01); *F25D 21/08* (2013.01); *F25D 31/002* (2013.01); *F25D 31/006* (2013.01)

(58) Field of Classification Search
CPC B67D 3/0009; B67D 3/0022; B67D 3/0058; F25D 31/006; F25D 21/08; F25D 31/002
See application file for complete search history.

(56) References Cited

U.S. PATENT DOCUMENTS

| | | | | |
|---|---|---|---|---|
| 5,996,842 | A | 12/1999 | Riley et al. | |
| 6,418,728 | B1 | 7/2002 | Monroe | |
| 6,619,061 | B2 | 9/2003 | Beaverson et al. | |
| 7,822,503 | B2 | 10/2010 | Merwarth et al. | |
| RE43,458 | E * | 6/2012 | Cleland | B67D 1/0861 62/196.1 |
| 8,640,486 | B2 | 2/2014 | Winters | |
| 8,769,973 | B2 | 7/2014 | Leaver et al. | |
| 8,973,786 | B2 | 3/2015 | Minard et al. | |
| 2005/0097909 | A1 * | 5/2005 | Cleland | B67D 1/0861 62/224 |
| 2008/0142115 | A1 | 6/2008 | Vogt et al. | |
| 2009/0327012 | A1 | 12/2009 | Sharma et al. | |
| 2010/0206400 | A2 | 8/2010 | Winkler et al. | |
| 2011/0011108 | A1 * | 1/2011 | Chadwell | B67D 1/0862 62/115 |
| 2011/0070348 | A1 | 3/2011 | Burton-Wilcock et al. | |
| 2011/0289947 | A1 * | 12/2011 | Chadwell | B67D 1/0862 62/115 |
| 2012/0067076 | A1 * | 3/2012 | Schroeder | B67D 1/0003 62/306 |
| 2012/0167597 | A1 | 7/2012 | Wilder et al. | |
| 2012/0312049 | A1 | 12/2012 | Downs, III et al. | |
| 2014/0208955 | A1 | 7/2014 | Yui | |
| 2014/0360208 | A1 | 12/2014 | Sadot et al. | |

FOREIGN PATENT DOCUMENTS

| | | |
|---|---|---|
| EP | 2690377 | 1/2014 |

* cited by examiner

*Primary Examiner* — Emmanuel Duke
(74) *Attorney, Agent, or Firm* — Fish & Tsang LLP

(57) ABSTRACT

A cooling system for a beverage comprises an enclosure for housing a beverage container, a cold plate through which the beverage flows, and a refrigeration system that controllably cools the enclosure and the cold plate in a differential manner. In preferred embodiments, preference is given during normal operation to cooling the cold plate, and only cooling the enclosure when the cold plate is determined to be at or below a desired temperature. In some embodiments a special defrost cycle warms the cold plate while continuing to cool the enclosure. Controls can be mechanical, electronic or any combination of the two, and preferably utilizes information from both pressure and temperature sensors.

19 Claims, 5 Drawing Sheets

PREFERENTIAL DISTRIBUTION OF COOLING CAPACITY

FIELD OF THE INVENTION

The present invention relates to methods and systems for preferentially cooling a cold plate and a supply container of the beverage cooling system.

BACKGROUND

The following description includes information that may be useful in understanding the present invention. It is not an admission that any of the information provided herein is prior art or relevant to the presently claimed invention, or that any publication specifically or implicitly referenced is prior art.

There are many cooling systems for beer or other beverages. Typically, most of the components of the refrigeration system are local to, and directly cool the keg or other beverage supply container. In other instances there are two refrigeration systems, one to cool the supply container, and another refrigeration system to cool a cold plate through which the beverage is passed just prior to dispensing.

For example, U.S. Pat. No. RE43,458E to Cleland ("Cleland") discloses a beverage chilling apparatus having a refrigerant cooling system. In Cleland, the cold plate is chilled by refrigerants that is compressed by a compressor and chilled by a condenser. However, Cleland fails to teach that the same compressor and condenser can also be used to chill the supply container.

Using two different refrigeration systems is inefficient, but to our knowledge, no one has ever undertaken the difficult task to cool both the supply container and a cold plate using a single refrigeration system.

All publications herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

Thus, there is still a need for improved refrigeration system, in which a given compressor can be used to cool both the supply container and a cold plate, simultaneously or otherwise.

DETAILED DESCRIPTION

Figure 1:
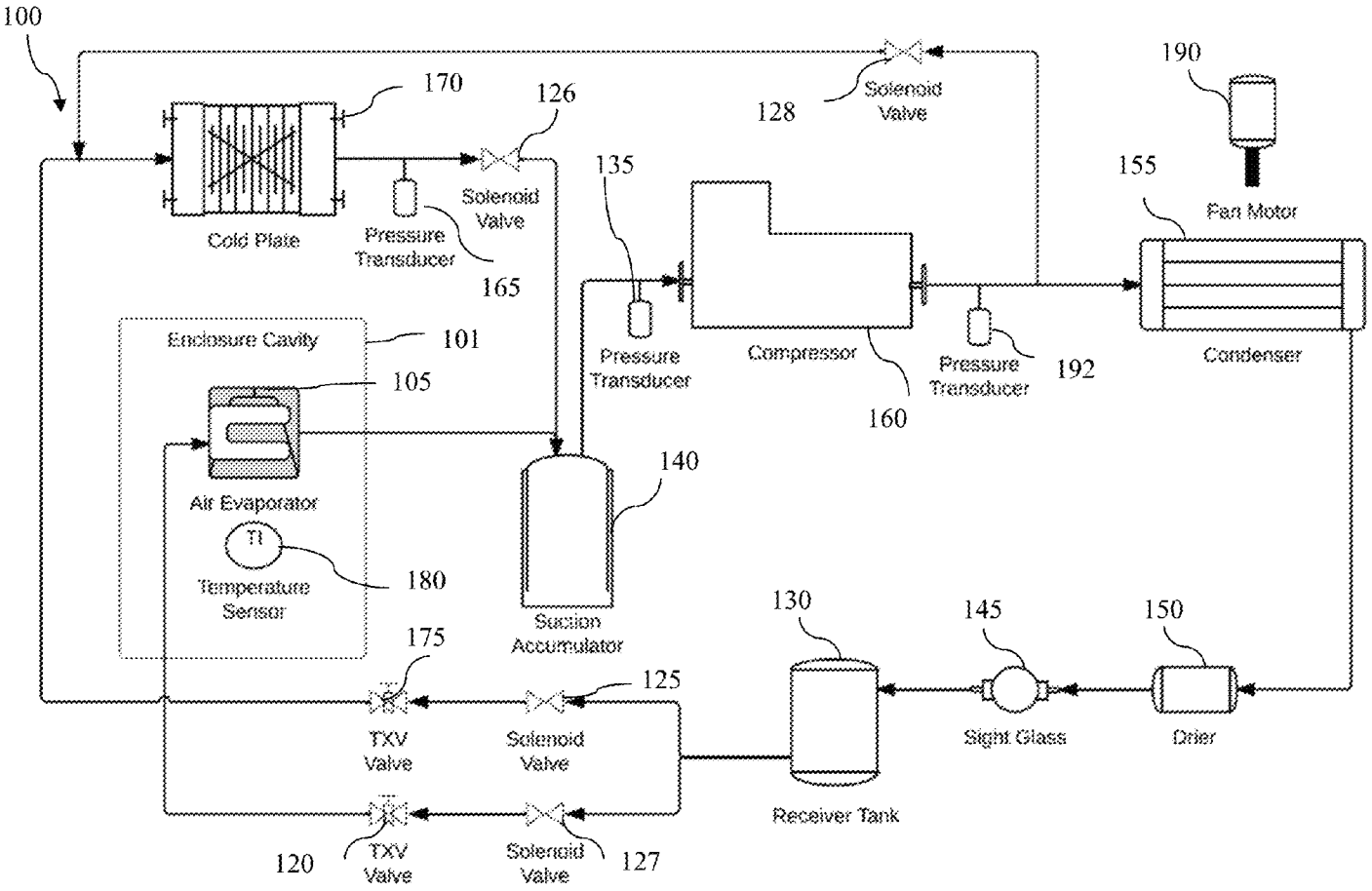
FIG. 1 is a schematic of the cooling system configured to cool both (a) an enclosure cavity for a supply container and (b) a cold plate.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

In some embodiments, the numbers expressing quantities of properties such as dimensions used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

Unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

The present invention provides apparatus, systems, and methods in which a cooling system comprises an enclosure having a cavity sized and dimension to house a beverage or other material to be cooled, a cold plate for further cooling the material, and a refrigeration system fluidly coupled to each of the cavity and the cold plate.

It is contemplated that the cavity can be in any size to house a beverage or other material to be cooled. Preferably, the size of the cavity can be at least 0.03 $m^3$. In some embodiments, where the smaller size of the cavity is preferred, the size of the cavity can be 0.02 $m^3$ or less. In these embodiments, the size of the cavity is preferably between 0.01 $m^3$ and 0.02 $m^3$, inclusive.

In one aspect of preferred embodiments, the cooling system includes one or more circuits that collectively control operation of the refrigeration system, including alteration of when and how much the cold plate is cooled relative to the cavity. For example, the cold plate could be cooled preferentially relative to the cavity. In another example, or at other times, the cold plate could be cooled simultaneously with cooling of the cavity.

In another aspect of preferred embodiments, the circuit(s) are configured to operate the refrigeration system in multiple different modes, including (a) a box mode in which the refrigeration system operates to cool the cavity, (b) a cold plate mode in which the refrigeration system operates to cool the cold plate, and (c) a cold plate defrost mode, in which the refrigeration system operates to defrost the cold plate. Some embodiments can also include (d) a box defrost mode, in which the refrigeration system operates to defrost the cavity.

In some embodiments, the cold plate defrost mode can utilize a valve that shunts hot refrigerant or other hot gas to the cold plate. The hot gas can advantageously be generated by turning off or otherwise lowering the speed of a condenser fan so that the refrigerant temperature increases, preferably to at least 50° C.). In some preferred embodiments, the cold plate defrost mode can utilize a circuit that cooperates with one or more temperature or pressure sensors to operate the valve. Alternatively or additionally, the cold plate defrost mode can be operated using a timer, and a resistance heater to provide heat to the cold plate.

The cooling system can be installed in any suitable structure, including for example in a wheel mounted cart, or as an under counter installation. Depending on the installation, the cold plate can be physically coupled to the enclosure by bolts, screws or other coupling. In other embodiments, the cold plate can be physically distal to the enclosure, such that the cold plate is coupled to the enclosure only by one or more fluid lines. In these embodiments, the cold plate would typically be spaced apart from the enclosure by at least 0.1 meter, and most likely between 0.1 meter and 5 meters.

The enclosure is preferably insulated, with at least one wall having an insulation R-value of at least 1, more preferably at least 2, and most preferably at least 3. As used herein, R-value is defined as square-meter Kelvin per watt ($m^2 \cdot K/W$). See http://sizes.com/units/rvalue.htm. The currently preferred materials for insulation include urea-formaldehyde or urethane foam.

In another aspect of preferred embodiments, the enclosure includes a door and a door switch, and the cooling system includes a circuit that cooperates with the door switch. For example, when the door of the enclosure opens, the circuit preferentially turns off refrigeration to the cavity, but not to the cold plate. Yet, in some embodiments, the circuit can turn off refrigeration to the cavity and the cold plate at the same time for at least some period of time (e.g., at least 1 second, at least 3 seconds, at least 5 seconds, etc.)

FIG. 1 is a schematic of the cooling system 100, which is configured to cool both (a) an enclosure cavity 101 for a supply container and (b) a cold plate 170. The cooling system 100 includes a receiver tank 130, which acts as the reservoir for the refrigerant. The receiver tank 130 fluidly communicates with the cold plate 170 via refrigerant line. The cooling system 100 also includes an enclosure cavity 101 having an evaporator 105 and a temperature sensor 180, a compressor 160, a condenser 155, an accumulator 140, expansion valves 120, 175 and a drier 150. The cooling system 100 further includes four solenoid valves 125, 126, 127,128, and three pressure transducers 135, 165, 192. In a preferred embodiment, the cooling system 100 further includes a sight-glass 145. Also, in some embodiments, the cooling system 100 also includes a fan motor 190 coupled with the condenser 155.

In some embodiments, the cold plate 170 comprises 40 pounds of cast aluminum, which is a standard cold plate known to those skilled in the art. In these embodiments, it is contemplated that the beverage and refrigerant lines may be wound or located within the cold plate 170 to increase the length of the lines positioned within the cold plate 170.

The cooling system 100 is configured to operate in a plurality of modes: cold plate cooling mode, box cooling mode, and cold plate defrost mode. In the cold plate cooling mode, the refrigerant enters the compressor 160 as a low pressure gas and is discharged from the compressor 160 as a high pressure gas. Then, the refrigerant passes through the Transducer C 192 and enters the condenser 155. The refrigerant is cooled in the condenser 155, exiting it as a high pressure liquid, and passes through a drier 150, which retains unwanted scale, dirt and moisture, and then through the sight-glass 145, where bubbles will be observed if the cooling system 100 is low on refrigerant.

Then, the refrigerant, which is still in a high pressure liquid state, enters the receiver tank 130, which serves as a storage or surge tank for the refrigerant. The refrigerant, then exits the receiver tank 130, and encounters the solenoid valve A 125 and then the first thermal expansion valve TXV 175. A pressure differential is provided across the thermal expansion valve 175. The thermal expansion valve 175 includes a sensor bulb that measures the degree (or lack) of superheat of the suction gas exiting the cold plate 170 and expands or contracts to allow the flow of refrigerant to be varied according to need. The refrigerant leaving the thermal expansion valve 175 will be in a low pressure liquid or liquid/vapor state when it enters the cold plate 170. The thermal expansion valve 175 is used instead of a capillary tube in order to provide improved response to the cooling needs of the cold plate 170.

In some embodiments, the thermal expansion valve 175 is coupled with a small equalizer tube connected to the downstream of the cold plate 170. In these embodiments, the equalizer tube helps to equalize the pressure between upstream and downstream side of the cold plate 170.

After passing through the thermal expansion valve 175, the refrigerant enters the cold plate 170. As the liquid or liquid/vapor refrigerant enters the cold plate 170, it is subjected to a much lower pressure due to the suction created by the compressor 160 and the pressure drop across the thermal expansion valve 175. It will also be adjacent warmer beverage lines. Thus, the refrigerant tends to expand and evaporate. In doing so, the liquid refrigerant absorbs energy (heat) from beverage lines within the cold plate 170.

In a preferred embodiment, a transducer A 165 is a pressure sensor, which is coupled with the refrigerant line just downstream of the cold plate 170, and measures pressure of the refrigerant coming out of the cold plate 170. In other embodiments, the transducer A 165 can be a temperature sensor, which measures the temperature of the refrigerant coming out of the cold plate 170. The low pressure gas leaving the cold plate 170 encounters the Solenoid valve B 126. From the Solenoid valve B 126, the gas passes into accumulator 140, which help prevent any slugs of liquid refrigerant from passing directly into the compressor 160, and continues back to the compressor 160.

The cold plate cooling mode begins by closing the solenoid valve A 125 and solenoid valve B 126 for a short time (e.g., less than 0.1 second, less than 0.2 second, less than 1 second, etc.). While the solenoid valve A 125 and solenoid valve B 126 is closed, either an electronic circuit (see FIG. 2) or a mechanical control mechanism (see FIG. 3) compares the refrigerant pressure derived from Transducer A 165 against a first set point pressure. The first set point pressure can vary based on the setting for the desired temperature. For example, if the desired temperature of the cold plate is about 29° F., then the first set point pressure is 67 psi. In other example, if the desired temperature of the cold plate is about 35° F., then the first set point pressure is 77 psi. However, the set point pressures can vary depending on the type of refrigerants.

If the refrigerant pressure derived from transducer A 165 is above the first set point pressure, then the electronic circuit or the mechanical control mechanism operates the cooling system 100 to open the solenoid valve A 125 and solenoid valve B 126 so that the refrigerant can flow through the cold plate 170. In some embodiments, the refrigerant pressures at the transducer A 165 are measured periodically (e.g., every 1 second, every 5 seconds, every 10 seconds, etc.) until the refrigerant pressures reaches to the first set point pressure. For each measurement, the solenoid valve A 125 and solenoid valve B 126 is closed, and then the refrigerant pressure derived from transducer A 125 is compared against a first set point pressure. Once the refrigerant pressure derived from transducer A 165 reaches to the first set point pressure, then the cooling system 100 is operated to switch the cold plate cooling mode to the box cooling mode.

In the box cooling mode, the refrigerant enters the compressor 160 as a low pressure gas and is discharged from the compressor 160 as a high pressure gas. The refrigerant passes through the Transducer C 192 and enters the condenser 155. The refrigerant is cooled in the condenser 155, exiting it as a high pressure liquid, and passes through a drier 150, which retains unwanted scale, dirt and moisture, and the through the sight-glass 145, where bubbles will be observed if the cooling system 100 is low on refrigerant.

Then, the refrigerant, which is still in a high pressure liquid state, enters the receiver tank 130, which serves as a storage or surge tank for the refrigerant. The refrigerant, then exits the receiver tank 130, and encounters the solenoid valve C 127 and then the thermal expansion valve TXV 120, while other solenoid valves 125, 126 are closed. The refrigerant leaving the thermal expansion valve 120 will be in a low pressure liquid or liquid/vapor state when it enters the enclosure cavity 101 having the evaporator 105 and the temperature sensor 180. At the evaporator 105, the refrigerant tends to expand and evaporate, which provides cooling capacity to the enclosure cavity 101.

The low pressure gas leaving the air evaporator 105 passes through the accumulator 140, which helps prevent any slugs of liquid refrigerant from passing directly into the compressor 160, then through the transducer B 135. The refrigerant continues back to the compressor 160.

In a preferred embodiment, the transducer B 135 is a pressure sensor, which is coupled with the refrigerant line just downstream of the cold plate 170, and measures pressure of the refrigerant coming out of the evaporators 105. In other embodiments, the transducer B 135 can be a temperature sensor, which measures the temperature of the refrigerant coming out of the evaporators 105.

In the box cooling mode, the enclosure cavity 101 is cooled while measuring the pressure between Solenoid A 125 and Solenoid B 126 to determine if it needs to go back to Cold Plate Cooling mode, which is the prioritized mode. The enclosure cavity 101 also includes the air thermometer 180, which is readable by the control board. The box cooling mode begins by opening the solenoid C valve 127 (corresponding to solenoid C valve 223 in FIG. 2, and solenoid C valve 323 in FIG. 3), and while solenoid A 125 (corresponding to solenoid C valve 225 in FIG. 2, and solenoid C valve 325 in FIG. 3) and B 126 (corresponding to solenoid C valve 226 in FIG. 2, and solenoid C valve 326 in FIG. 3) are closed, it checks pressure between solenoid A 125 and B 126.

If the pressure is above the set point between solenoid A 125 and B 126 while in box cooling mode, then it goes back to the cold plate cooling mode. If the box thermometer 180 hits its set point while in box cooling mode, then solenoid C 127 closes (solenoid A 125 and B 126 are already closed) and the control board reads pressure at pressure transducer B 135. Once the board sees pressures, which is read at pressure transducer B 135, reaches the set point, the compressor 160 turns off and goes into an idle mode.

In some embodiments, the cooling system 100 is configured to continue monitoring the pressure (or temperature) at the transducer A 165. For example, during the idle mode, the system 100 constantly reads pressure transducer 165 (corresponding to pressure transducer 265 in FIG. 2, or pressure transducer 365 in FIG. 3) and box thermometer (temperature sensor) 180 (corresponding to box thermometer 280 in FIG. 2) while the compressor is off. If the pressure transducer 165 (corresponding to pressure transducer 265 in FIG. 2 and pressure transducer 365 in FIG. 3) sees its above set point, it goes to cold plate mode. If the box thermometer (temperature sensor) 180 (corresponding to box thermometer 280 in FIG. 2)(or pressure transducer 336 in FIG. 3) sees its above set point, it goes into the box cooling mode. If the pressure (or temperature) of refrigerant between Solenoid A 125 and B 126 (corresponding to Solenoid A 225 and B 226 in FIG. 2, Solenoid A 325 and B 326 in FIG. 3) and is above the first set point during the box cooling mode, the cooling system 100 is configured to turn off solenoid C valve 127 (corresponding to Solenoid C 223 in FIG. 2, and Solenoid C 323, 329 in FIG. 3) and begins the cold plate cooling mode. Thus, the cooling system 100 preferentially allocates the cooling capacity to the cold plate over the box evaporators.

In some embodiments, the cooling system further includes another solenoid between the pressure transducer 336 (as shown in cooling system 300 in FIG. 3) and the suction accumulator 140 (corresponding to suction accumulator 240 in FIG. 2 or suction accumulator 340 in FIG. 3) to measure the pressure of the cavity of the cooling system 100. In these embodiments, the enclosure cavity 101 is cooled the same way as the cold plate mode described above. The difference is instead of closing Solenoid A 125 and B 126, it closes C 127 (corresponding to Solenoid C 223 in FIG. 2, and Solenoid C 323, 329 in FIG. 3) (and Solenoid E 329 in FIG. 3).

During the cold plate defrost mode, the Condenser Fan 190 is off, Solenoid B 126 and C 127 are opened and Solenoid A 125 and D 128 are closed. This configuration allows refrigerant to leave the cold plate and build up high pressure hot gas for set time (e.g., at least 10 seconds, at least 30 seconds, at least 1 minute, at least 5 minutes, etc.). Then, the pressure at the transducer 192 is monitored until it reaches its high pressure set point (e.g., 250 psi). Once the pressure hits its high pressure set point, Solenoid D 128 opens for a few seconds to let high pressure hot gas into the cold plate 170. Once the high pressure hot gas is introduced, then, Solenoid B 126 and D 128 is closed and a pressure at the transducer 165 is checked to see if the cold plate 170 warmed up to a predetermined temperature. If the temperature at the cold plate 170 does not reach the set point, then the cold plate defrost mode is repeated until the cold plate 170 warmed up to the set point. If it hit its set point, then the system 100 goes back to idle mode. In some embodiments, the cold plate defrost mode begins automatically by detecting the temperature of the cold plate 170. In other embodiments, the cold plate defrost mode begins only when a user initiate the cold plate defrost mode (e.g., by clicking a button, etc.)

In some embodiments, the cooling system is configured to run a box defrost mode upon the user's choice of mode. For example, when the user of the system 100 clicks the button to use Defrost mode, defrost mode becomes priority. In other embodiments, the box defrost mode is operated by a timer without a user's intervention. In the box defrost mode, all valves are closed and the compressor 160 is turned off for a set time (e.g., at least 1 minute, at least 5 minutes, at least 10 minutes, etc.), so that the enclosure cavity 101 can be defrosted under the temperature substantially close to the room temperature. However, the machine may still go into cold plate mode or cold plate defrost mode if needed during box defrost mode.

Figure 2:
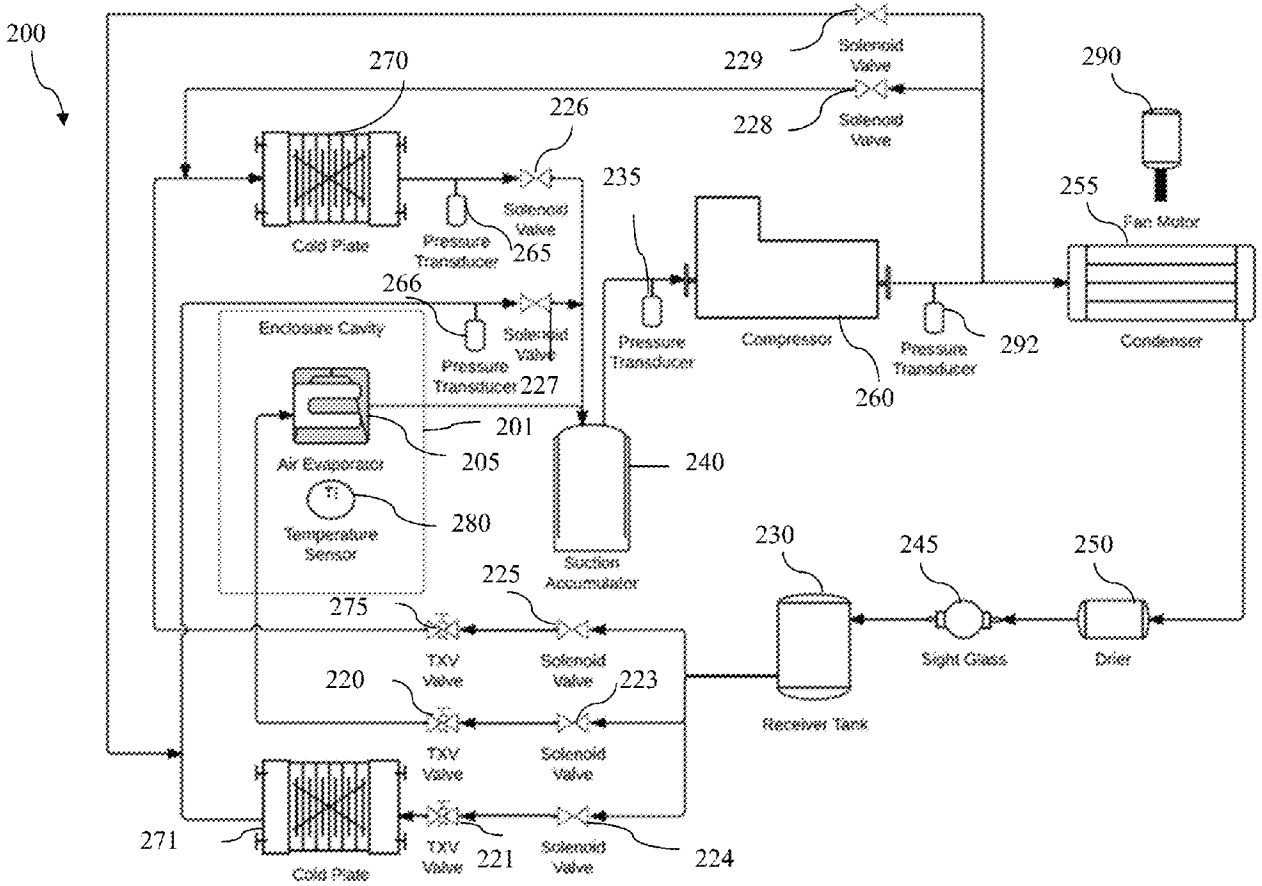
FIG. 2 is a schematic of one embodiment of the cooling system configured to cool both (a) an enclosure cavity for a supply container and (b) two cold plates.

FIG. 2 shows a schematic of one embodiment of an alternative cooling system 200 configured to cool both (a) an enclosure cavity 201 for a supply container and (b) two cold plates 270, 271. In this cooling each of two cold plates 270, 271 are coupled with a pressure transducer 265 or 266, and a solenoid valve 226 or 227, in its downstream, and a TXV valve 275 or 221, and a solenoid valve 225 or 224, in its upstream, respectively. For a defrost mode, the cooling system 200 further includes a solenoid 229, which plays a similar role to the cold plate 271 with a solenoid 228 to the cold plate 270 (corresponding to Solenoid D 128 in FIG. 1).

Figure 3:
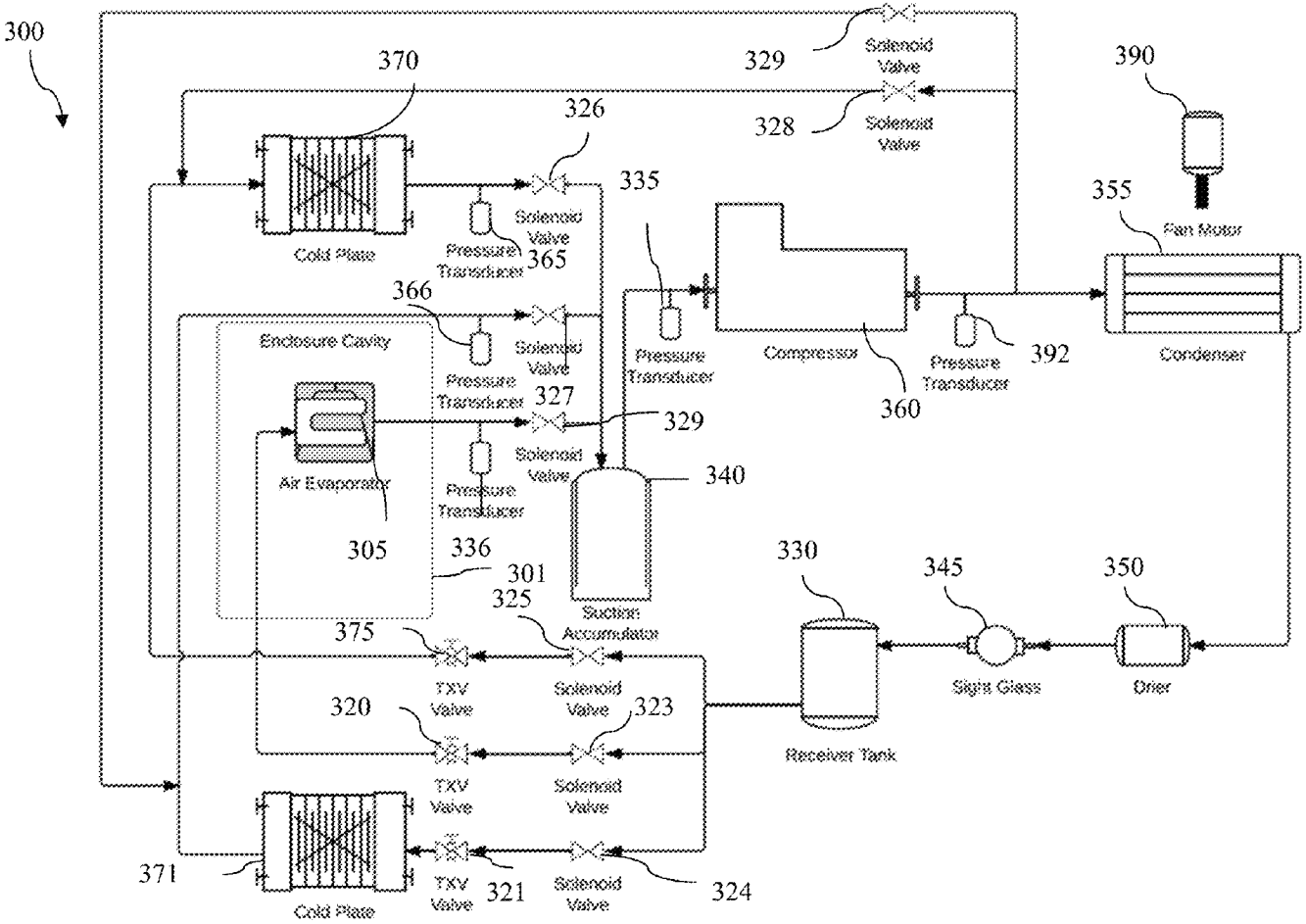
FIG. 3 is a schematic of another embodiment of the cooling system configured to cool both (a) an enclosure cavity for a supply container and (b) two cold plates.

FIG. 3 shows a schematic of another embodiment of an alternative cooling system 300 configured to cool both (a) an enclosure cavity 301 for a supply container and (b) two cold plates 370, 371. In this cooling each of two cold plates 370, 371 are coupled with a pressure transducer 365 or 366, and a solenoid valve 326 or 327, in its downstream, and a TXV valve 375 or 321, and a solenoid valve 325 or 324, in its upstream, respectively. For a defrost mode, the cooling system 300 further includes a solenoid 329, which plays a similar role to the cold plate 371 with a solenoid 328 to the cold plate 370 (corresponding to Solenoid D 128 in FIG. 1). In this embodiment, the cooling system 300 does not include a temperature sensor 180, 280 in the enclosure cavity 101, 201 as shown in FIGS. 1 and 2. Instead, the system 300 is operated by measuring pressures in the pressure transducers only.

The cooling system 300 further includes another solenoid 329 and pressure transducer 336 in FIG. 3 between the evaporator 305 and the suction accumulator 330 to measure the pressure of the evaporator 305 of the cooling system 300. In this embodiment, when the pressure transducer 336 sees its above set point during box cooling more, the cooling system 300 is configured to turn off solenoid C valve 323 and solenoid 329 and begin the idle mode.

Similar to the cooling system 100 of FIG. 1, the cooling systems 200, 300 are configured to operate in a plurality of modes: cold plate cooling mode, box cooling mode, and cold plate defrost mode. The mechanisms of operating of the plurality of modes of the cooling systems 200, 300 are substantially same with cooling system 100 as described above.

Figure 4:
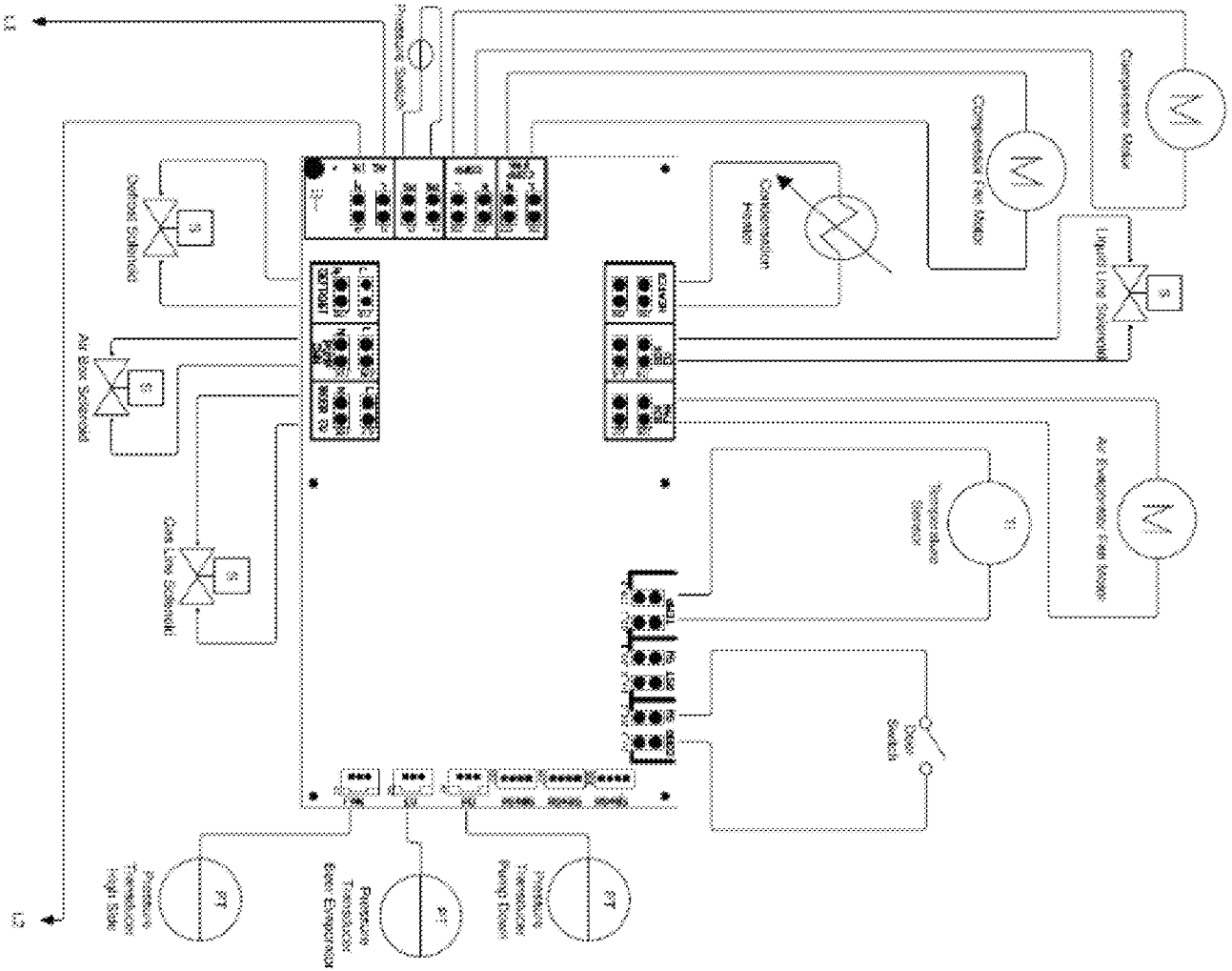
FIG. 4 is a schematic of electronic controls for the cooling system.

FIG. 4 is a schematic of exemplary digital control box for the cooling system of FIG. 1. It is generally preferred that one digital control box comprises a plurality of circuit boards, each of which is coupled with at least one transducer, sensor motor, heater, solenoid or door and communicate with those. For example, each of a defrost circuit, a pump-down circuit, and beer evaporator circuit is coupled with a defrost solenoid, airbox solenoid, and gas line solenoid, respectively, and controls open and close of the solenoid. For another example, temperature sensor circuit is coupled with a temperature sensor, and receives temperature sensor data. In this embodiment, it is preferred that the digital control box further comprises a main control board, which is configured to communicate with a plurality of circuits in the box and store the pre-set values for temperature or pressure to enable automatic controlling based on pre-programmed command.

Figure 5:
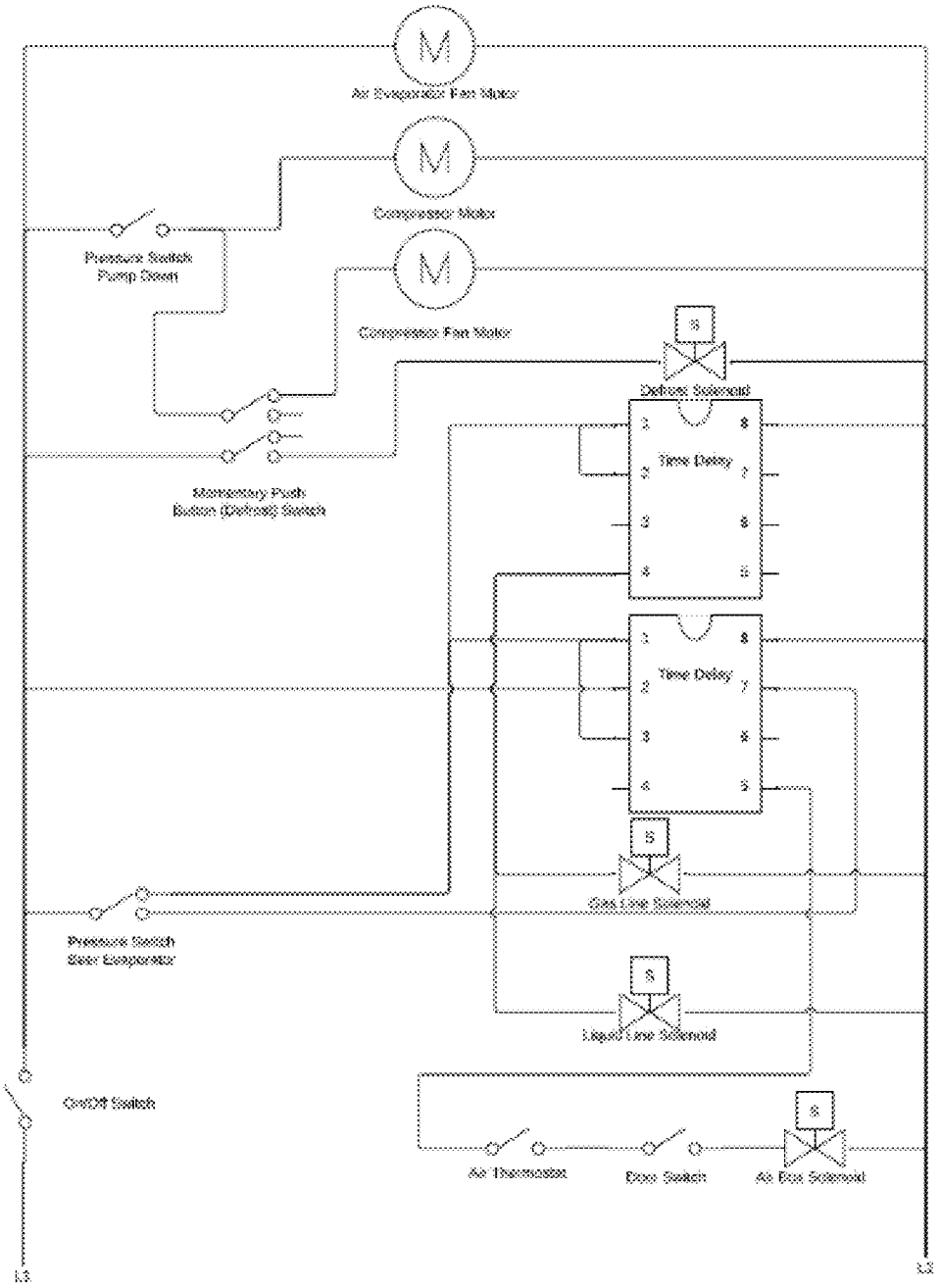
FIG. 5 is a schematic of mechanical controls for the cooling system.

FIG. 5 is a schematic of exemplary analog control mechanisms to operate the cooling system of FIG. 1. In a preferred embodiment, the analog control mechanisms include two time delay control boxes that are coupled with each other. Each time delay control box is coupled with at least one or more switches or solenoids via one or more sections to control its opening and closing. In some embodiments, the time delay control boxes comprises at least one transistor and capacitor, a delay time per section can either be controlled by an external voltage or locked to an external reference frequency by means of a control system which features a large capture range.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A cooling system for a beverage disposed in a container, comprising: an enclosure having a cavity sized and dimension to house the container; a cold plate; and a refrigeration system fluidly coupled to each of the cavity and the cold plate; and wherein the refrigeration system is configured to cool either the cavity or the cold plate from time to time, but not the cavity and the cold simultaneously.

2. The cooling system of claim 1, further comprising a circuit that cooperates with the refrigeration system to preferentially cool the cold plate relative to the cavity.

3. The cooling system of claim 1, wherein the refrigeration system is configured to simultaneously cool the cavity and the cold plate at other time.

4. The cooling system of claim 1, having a defrost mode in which a valve shunts a hot gas to the cold plate.

5. The cooling system of claim 4, wherein the refrigeration system includes a fan that cooperates with a condenser to cool a refrigerant, and further comprising a circuit configured to cause heating of the refrigerant by lowering a speed of the fan.

6. The cooling system of claim 4, further comprising a sensor configured to sense at least one of a pressure and a temperature of the hot gas, and a circuit that cooperates with the sensor to trigger opening of the valve.

7. The cooling system of claim 4, further comprising a sensor configured to sense at least one of a pressure and a temperature of the hot gas, and a circuit that cooperates with the sensor to trigger both opening and closing of the valve.

8. The cooling system of claim 4, further a circuit that uses a timer to at least partially control operation of the defrost mode.

9. The cooling system of claim 1, having a defrost mode that uses a resistance heater to provide heat to the cold plate.

10. The cooling system of claim 1, further comprising an electronic circuit configured to operate the cooling system in (a) a box mode in which the refrigeration system operates to cool the cavity, (b) a cold plate mode in which the refrigeration system operates to cool the cold plate, and (c) a cold plate defrost mode, in which the refrigeration system operates to defrost the cold plate.

11. The cooling system of claim 10, wherein the electronic circuit is further configured to operate the cooling system in (d) a box defrost mode, in which the refrigeration system operates to defrost the cavity.

12. The cooling system of claim 1, wherein the cold plate is physically coupled to the enclosure by a coupling other than a fluid line.

13. The cooling system of claim 1, wherein the cold plate is spaced apart from the enclosure by at least 0.1 meter.

14. The cooling system of claim 1, wherein the enclosure has a wall having an insulation R-value of at least 3.

15. The cooling system of claim 1, further comprising a door switch, and a circuit that cooperates with the door switch to turn off refrigeration to the cavity, but not to the cold plate.

16. The cooling system of claim 1, wherein the cavity is at least 0.03 M3.

17. The cooling system of claim 1, wherein the cavity is between 0.01 M3 and 0.02 M3, inclusive.

18. The cooling system of claim 1, further comprising a mechanical controller configured to operate the cooling system in (a) a box mode in which the refrigeration system operates to cool the cavity, (b) a cold plate mode in which the refrigeration system operates to cool the cold plate, and (c) a cold plate defrost mode, in which the refrigeration system operates to defrost the cold plate.

19. The cooling system of claim 18, wherein the mechanical controller is further configured to operate the cooling system in (d) a box defrost mode, in which the refrigeration system operates to defrost the cavity.

* * * * *